US010030412B2

(12) United States Patent
Danner, Jr.

(10) Patent No.: US 10,030,412 B2
(45) Date of Patent: Jul. 24, 2018

(54) HANDCUFF SHIELD

(71) Applicant: Jess M. Danner, Jr., Akron, OH (US)

(72) Inventor: Jess M. Danner, Jr., Akron, OH (US)

( * ) Notice: Subject to any disclaimer, the term of this patent is extended or adjusted under 35 U.S.C. 154(b) by 0 days.

(21) Appl. No.: 14/573,337

(22) Filed: Dec. 17, 2014

(65) Prior Publication Data

US 2017/0081878 A1 Mar. 23, 2017

(51) Int. Cl.
*E05B 75/00* (2006.01)
*E05B 17/14* (2006.01)

(52) U.S. Cl.
CPC ..... *E05B 17/14* (2013.01); *E05B 75/00* (2013.01)

(58) Field of Classification Search
CPC ..... A61F 5/37; A61F 5/3723; E05B 75/00; E05B 75/005; E05B 17/14; E05B 17/186
USPC ..... 70/16, 15, 17, 423, 424, 427, 428, 455; 128/878, 879; 2/16, 17, 162, 910; 119/770, 816, 819; 224/914
See application file for complete search history.

(56) References Cited

U.S. PATENT DOCUMENTS 3,616,665 A * 11/1971 Rosenthal ..... 70/16
3,740,977 A * 6/1973 Stefansen et al. ..... 70/16
4,741,051 A * 5/1988 Bible ..... 2/158
4,840,048 A * 6/1989 Elam ..... 70/16
5,007,257 A * 4/1991 Thompson ..... 70/16
5,233,848 A * 8/1993 Elam ..... 70/16
5,343,562 A * 9/1994 Bible ..... 2/16
5,526,658 A * 6/1996 Cross et al. ..... 70/16
5,680,781 A * 10/1997 Bonds et al. ..... 70/16
5,732,576 A * 3/1998 Moore et al. ..... 70/16
6,000,249 A * 12/1999 Wilber ..... 70/16
6,886,374 B2 * 5/2005 Clifton, Jr. ..... 70/16
7,010,943 B1 * 3/2006 Earl ..... 70/16
7,284,399 B1 * 10/2007 Sisco ..... 70/16
7,942,152 B1 * 5/2011 Foster et al. ..... 128/879
8,522,581 B2 * 9/2013 Thompson ..... 70/16
2004/0216501 A1 * 11/2004 Clifton, Jr. ..... 70/16
2009/0277229 A1 * 11/2009 Smith ..... 70/16
2010/0269549 A1 * 10/2010 Isaacs ..... 70/16
2013/0133382 A1 * 5/2013 Thompson ..... 70/16

FOREIGN PATENT DOCUMENTS

GB 2268778 * 1/1994

* cited by examiner

*Primary Examiner* — Lloyd A Gall
(74) *Attorney, Agent, or Firm* — Emerson Thomson Bennett LLC; John M. Skeriotis

(57) ABSTRACT

A handcuff shield includes first and second walls connected by an end wall to form a channel for receiving a pair of handcuffs. A slotted opening is formed in the first and second walls to receive a chain link or hinged for locking the handcuff shield to the handcuffs. When attached to the handcuffs, the end wall of the handcuff shield covers and prevents access to a ratchet mechanism of the handcuffs, and the first and second walls of the handcuff shield cover and prevent access to the keyhole of the handcuffs.

2 Claims, 4 Drawing Sheets

HANDCUFF SHIELD

FIELD OF INVENTION

The present disclosure relates to a handcuff shield. More particularly, the present disclosure relates to a shield for handcuffs that prevents the unauthorized release of the handcuffs.

BACKGROUND

Law enforcement personnel and prison guards routinely use handcuffs for prisoner restraint. Handcuffs are generally of standardized construction and include a pair of wristlets pivotally and rotatably connected by a short link chain or hinged. Each wristlet comprises a ratchet mechanism consisting of a ratchet bar pivotally connected to a wristlet body. The ratchet bar and wristlet body have opposed teeth such that when the ratchet bar is pivoted into the wristlet body, the teeth of the ratchet bar engage the teeth of the wristlet body to prevent withdrawal of the ratchet bar in the opposite direction. Once applied to the wrist of a prisoner, the ratchet bar is released or disengaged with a key insertable into a keyhole on the wristlet.

A problem encountered in the use of conventional handcuffs is that prisoners have a certain degree of freedom to manipulate their hands because of the flexible connection between the wristlets. As such, it is possible for a prisoner to escape from the handcuffs by inserting an object into the ratchet mechanism to release the ratchet bar from the wristlet body, or by picking the lock. To avoid such problems, shielding and reinforcing devices have been previously proposed to help prevent the unauthorized release of these handcuffs.

To this end, what is needed is a handcuff shield that can be easily and quickly attached to handcuffs to prevent access to the ratchet mechanism and keyhole. The shield locks to the handcuffs covering the ratchet mechanism and keyhole to prevent the unauthorized release of the handcuffs.

SUMMARY OF THE INVENTION

In one embodiment, a handcuff shield includes a first wall, a second wall extending parallel to and spaced from the first wall, and an end wall connecting the first wall and the second wall to form a channel therebetween for receiving a pair of handcuffs. The end wall covers a ratchet mechanism of the pair of handcuffs to prevent the unauthorized release of the pair of handcuffs when the handcuff shield is attached thereto.

In another embodiment, a handcuff assembly includes handcuffs having a pair of wristlet bodies attached to one another by a chain link or hinged. The wristlet bodies are each formed with a set of teeth. A ratchet bar is pivotally attached to each wristlet body with each ratchet bar being formed with a set of teeth. When the ratchet bar pivots towards the wristlet body, the teeth of the ratchet bar engage the teeth of the wristlet body to lock the handcuffs to a prisoner. The handcuff assembly further includes a handcuff shield formed with a first wall, a second wall and an end wall that connects the first wall to the second wall to form a channel therebetween. The handcuff shield slidably receives the handcuffs within the channel such that the end wall of the handcuff shield covers the wristlet body to prevent access to the engaged teeth of the wristlet body and ratchet bar.

In yet another embodiment, a method of securing a prisoner includes attaching handcuffs to the prisoner by latching a ratchet mechanism of the handcuffs to secure the handcuffs to the prisoner until released by inserting a key into a keyhole of the handcuffs. The method further includes sliding a handcuff shield over the handcuffs to cover the latching mechanism and keyhole and inserting a locking device into a slotted opening formed in the handcuff shield to lock the handcuff shield to the handcuffs such that the handcuff shield prevents unauthorized access to the ratchet mechanism and keyhole of the handcuffs.

BRIEF DESCRIPTION OF DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and proportion of certain elements may be exaggerated for the purpose of illustration.

DETAILED DESCRIPTION

Figure 1:
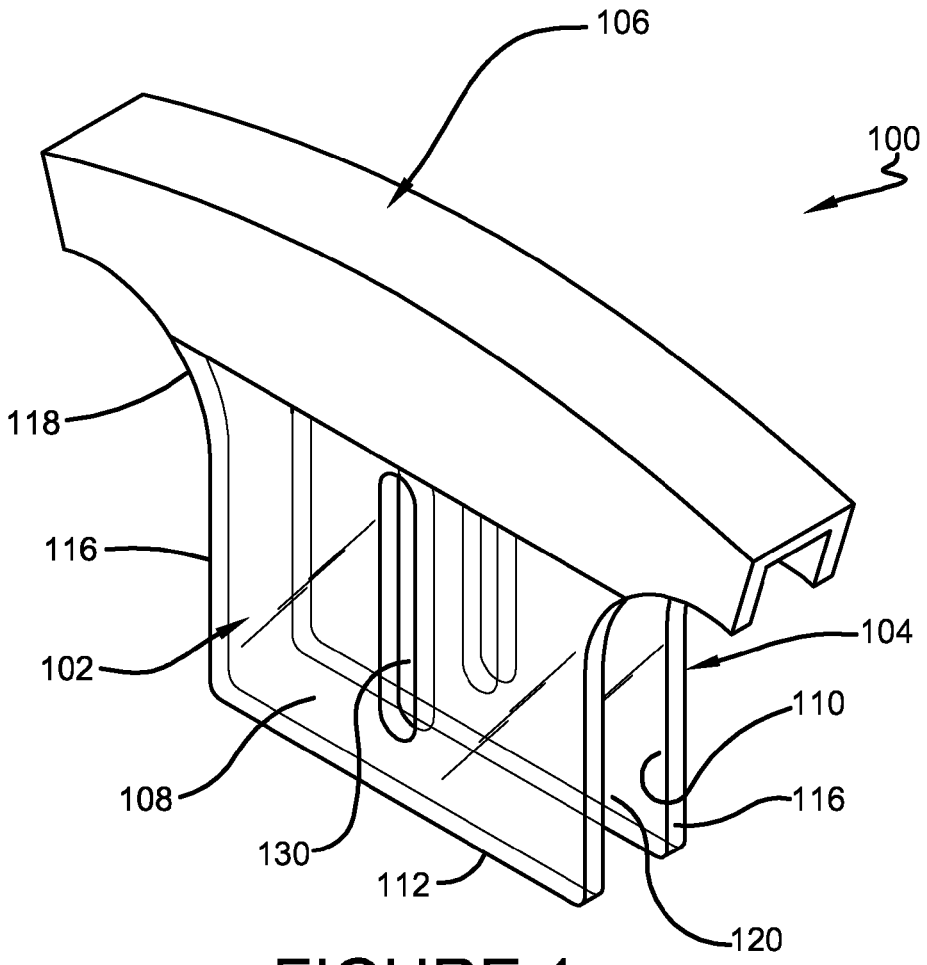
FIG. 1 is a perspective view of an example embodiment of a handcuff shield.
Figure 3:
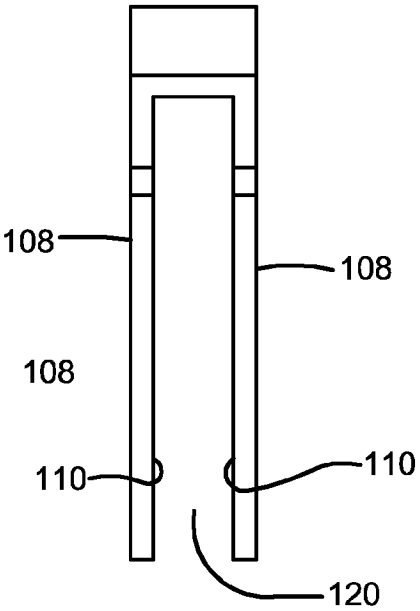
FIG. 3 is a side view of the handcuff shield of FIG. 1.
Figure 2:
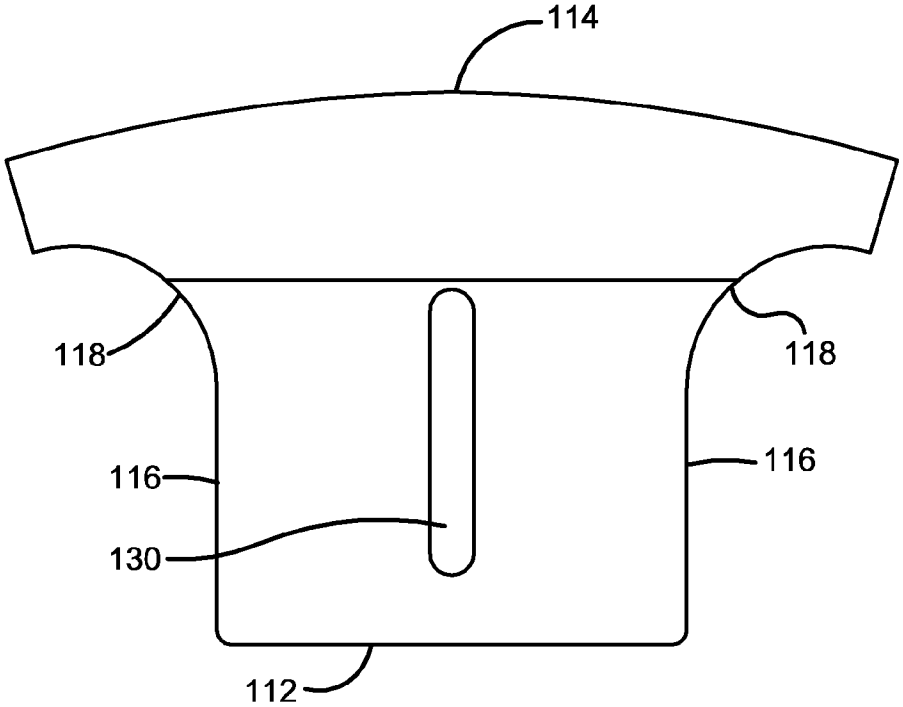
FIG. 2 is a front view of the handcuff shield of FIG. 1.

FIGS. 1-3 show a handcuff shield 100. Handcuff shield 100 is formed by a first wall 102, a second wall 104 and an end wall 106. In the illustrated embodiment, first wall 102 and second wall 104 are identical in shape and include outer surfaces 108, opposed inner surfaces 110, bottom edges 112, slightly curved top edges 114 and side edges 116. Side edges 116 extend perpendicularly from bottom edge 112 then curve outwardly to form arcuate angled sections 118.

As shown in FIG. 1, end wall 106 attaches first wall 102 to second wall 104 at curved top edges 114 and is curved at the same radius as curved top edges 114. First wall 102 and second wall 104 extend parallel to one another and are spaced apart to form an inner channel 120.

As shown in FIGS. 1 and 2, first wall 102 and second wall 104 are formed with a slotted opening 130. The slotted openings 130 of each wall 102 and 104 are aligned to allow a link of a chain or other locking device to be received therethrough.

Figure 4:
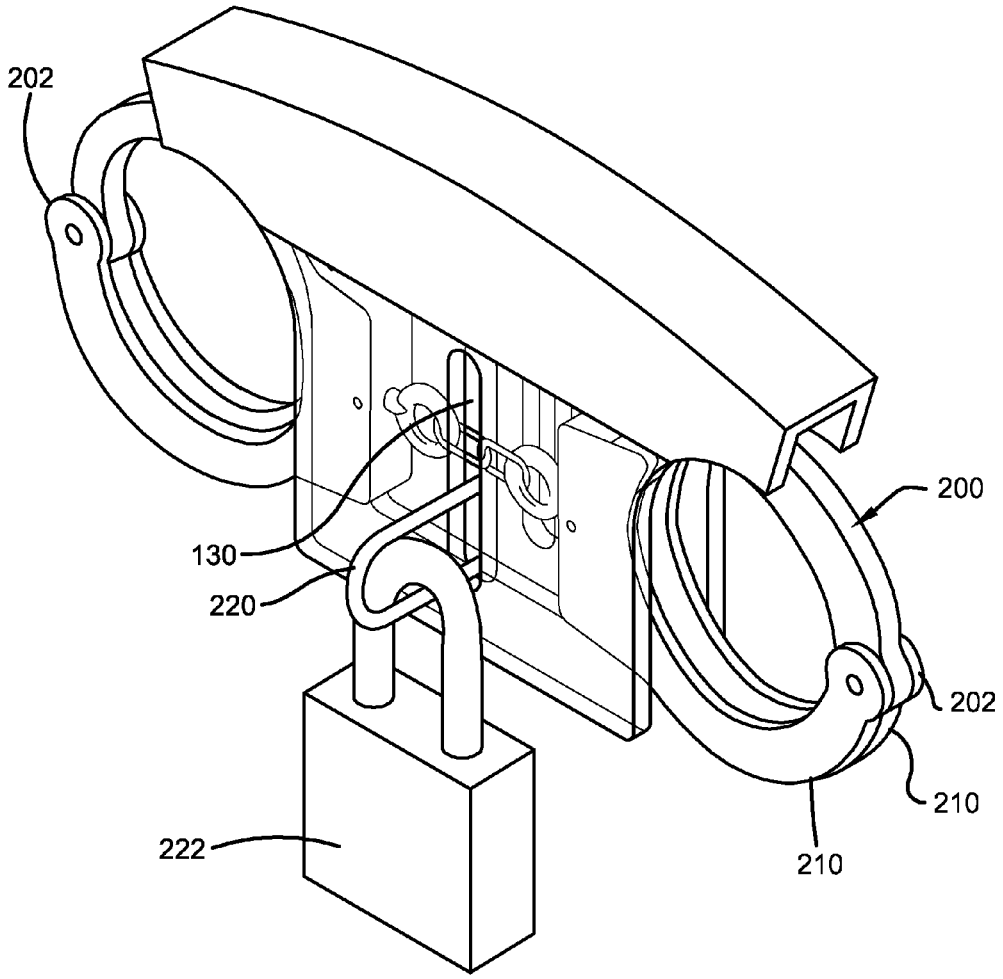
FIG. 4 is a perspective view of an example embodiment of a handcuff assembly including a handcuff shield.
Figure 6:
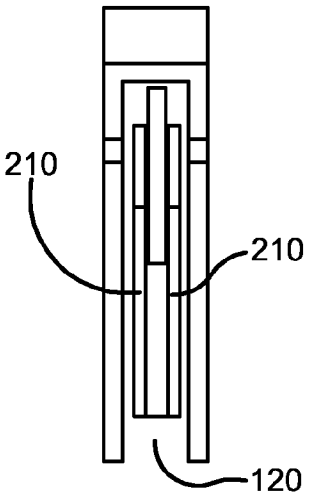
FIG. 6 is a side view of the handcuff assembly of FIG. 4.
Figure 5:
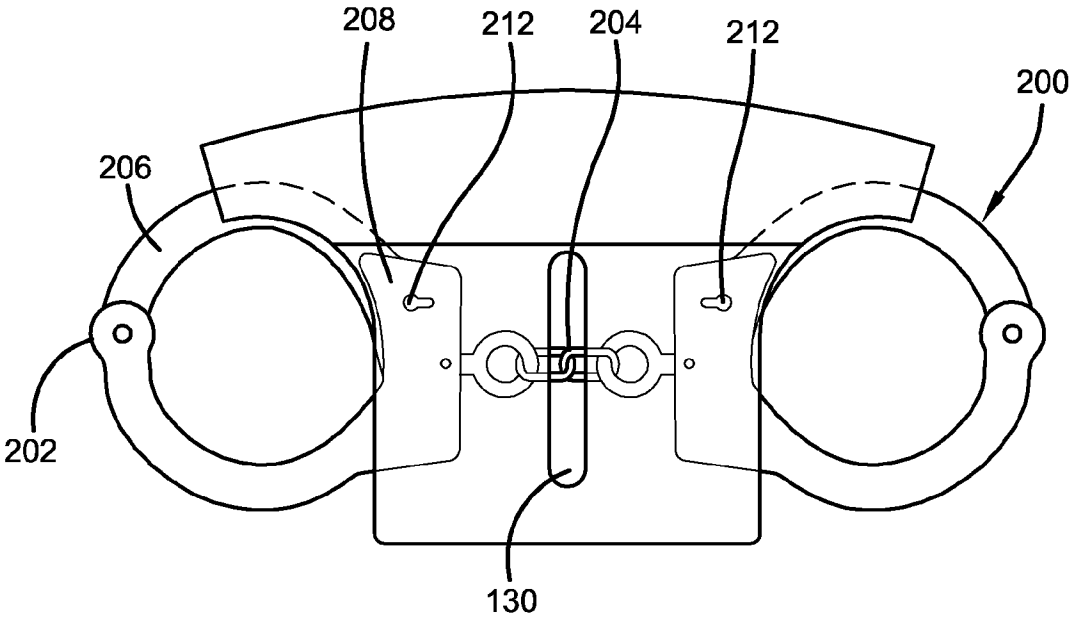
FIG. 5 is a front view of the handcuff assembly of FIG. 4.

With reference to FIGS. 4-6, channel 120 is open along the bottom edge 112 and side edges 116 of walls 102 and 104, and is of sufficient width to allow handcuff shield 100 to receive a pair of conventional handcuffs 200. Handcuffs 200 are well known in the art and are of the type typically used by law enforcement officers. Handcuffs 200 contain a pair of wristlets 202 connected to one another by a short chain 204. Each wristlet includes a ratchet mechanism having a ratchet bar 206 pivotally connected to a wristlet body 208. As shown in FIG. 6, wristlet body 208 is formed by two side walls 210 and includes internal teeth (not shown). Ratchet bar 206 includes teeth (not shown) that are opposed to the teeth of wristlet body 208 such that when ratchet bar 206 is pivoted into wristlet body 208 the teeth of ratchet bar 206 engage the teeth of wristlet body 208 to latch the ratchet mechanism and prevent the withdrawal of ratchet bar 206 until released or disengaged by inserting a key into keyhole 212.

Handcuffs 200 are shown in FIGS. 4-6 in the locked position with handcuff shield 100 attached thereto. By way of example, when attaching handcuffs 200 to a prisoner, the law enforcement officer will instruct the prisoner to put his hands out with his palms facing each other. The officer will insert the prisoner's wrists into wristlet body 208 from the bottom and pivot ratchet bar 206 over the top the prisoner's wrists to secure the wristlets 202 to the prisoner. The officer will then slide handcuff shield 100 over the top of ratchet bar 206 such that end wall 106 covers and prevents access to wristlet body 208 and ratchet bar 206, and walls 102 and 104 cover and prevent access to keyhole 212. A chain link 220 is inserted through slotted opening 130 and attached thereto by a lock 222 to prevent the removal of handcuff shield 100 from handcuffs 200.

While FIGS. 4-6 show a chain and padlock used to secure handcuff shield 100 to handcuffs 200, it is understood that other locking device could be used to achieve the same results. For example, pad lock 222 could be inserted directly through channel 130 to attach the shielding device 100 to handcuffs 200. Further, as best shown in FIG. 6, channel 120 is just slightly wider than the width of handcuffs 200 to sandwich handcuffs 200 between the opposed inner surfaces 110 of walls 102 and 104 so that when attached to the handcuffs, handcuff shield 100 cannot be manipulated by the prisoner.

As shown in FIG. 5, arcuate angles 118 of side edges 116 generally follow the radius of handcuffs 200 when in the locked position to provide sufficient clearance for the prisoner's wrists. Additionally, curved top edges 114 of the first and second walls and end wall 106 generally follow the curvature of the outside of handcuffs 200 when in the wristlets are in the extended and locked position of FIG. 5 and they accommodate different-sized wrists.

Handcuff shield 100 quickly and easily attaches to a standard pair of handcuffs to shield the ratchet mechanism and keyhole of the handcuffs from access. When in the attached and locked position of FIGS. 4-6, handcuff shield 100 will prevent the unauthorized release of handcuffs 200. The materials of the handcuff shield can be any material of sound engineering judgment. Preferable, the walls 102 and 104 are clear to allow the officer to see the locks on the handcuff shield.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicant intends to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the application, in its broadest aspects, is not limited to the specific details, the representative apparatus and method, and illustrative examples shown and described. Accordingly, departures may be made from such details without departing from the spirit or scope of the applicant's general inventive concept.

What is claimed is:

1. A handcuff shield comprising:

a first wall;

a second wall extending parallel to, spaced from and opposed to said first wall;

a top wall connecting said first wall and said second wall to form a fixed width channel therebetween;

wherein the channel is dimensioned to slidably receive an associated pair of handcuffs while said handcuffs are operationally engaged with one or more wrists of an associated prisoner, said associated pair of handcuffs having a first ratchet bar adapted to be pivotable between a closed position and a released position, to provide a clearance fit around the associated pair of handcuffs, to cover and prevent access to one or more keyholes of the associated pair of handcuffs; and is adapted to prevent disengagement of the associated pair of handcuffs from the one or more wrists by obstructing the region between the closed position of the first ratchet bar and the released position of the first ratchet bar.

2. A handcuff-shield assembly comprising:

a pair of handcuffs adapted to be attached to an associated first wrist and an associated second wrist, the pair of handcuffs having a first wristlet having a first wristlet body and a second wristlet having a second wristlet body, wherein the first wristlet body is connected to the second wristlet body by a short chain, the first wristlet has a first ratchet bar connected to the first wristlet body by a pivot adapted to permit the first ratchet bar to be moved between a closed position of the first ratchet bar defining a wrist-shaped closed curved cavity which is adapted to fit tightly around the first wrist and thereby secures the first wrist therein, and a released position of the first ratchet bar, which permits the first wrist therein to be removed, only when the region between the closed position of the first ratchet bar and the released position of the first ratchet bar is unobstructed, the second wristlet has a second ratchet bar connected to the second wristlet body by a pivot adapted to permit the second ratchet bar to be moved between a closed position of the second ratchet bar defining a wrist-shaped closed curved cavity which is adapted to fit tightly around the second wrist and thereby secures the second wrist therein, and a released position of the second ratchet bar, which permits the second wrist therein to be removed, only when the region between the closed position of the second ratchet bar and the released position of the second ratchet bar is unobstructed, a handcuff shield having a first wall, a second wall extending parallel to, spaced from and opposed to said first wall, a top wall connecting said first wall and said second wall to form a fixed width channel therebetween, wherein the channel is dimensioned to slidably receive the pair of handcuffs while said handcuffs are operationally engaged with the associated first wrist and the associated second wrist, to provide a clearance fit around the associated pair of handcuffs, and to cover and prevent access to one or more keyholes of the associated pair of handcuffs, and wherein the handcuff shield obstructs the region between the closed position of the first ratchet bar and the released position of the first ratchet bar, and obstructs the region between the closed position of the second ratchet bar and the released position of the second ratchet bar.

* * * * *